United States Patent [19]

Paque

[11] Patent Number: 4,844,636

[45] Date of Patent: Jul. 4, 1989

[54] UNITARY TAPE-RIBBON CARTRIDGE FOR LETTERING SYSTEM

[75] Inventor: Michael W. Paque, Phoenix, Ariz.

[73] Assignee: Kroy Inc., St. Paul, Minn.

[21] Appl. No.: 43,463

[22] Filed: Apr. 28, 1987

[51] Int. Cl.[4] ..... B41J 35/28; B41J 32/00

[52] U.S. Cl. ..... 400/208; 400/134.6; 400/236.2; 400/613

[58] Field of Search ..... 400/207, 208, 613, 134.6, 400/236.2

[56] References Cited

U.S. PATENT DOCUMENTS

| | | | |
|---|---|---|---|
| 494,357 | 3/1893 | Walkup | 400/236.2 X |
| 4,226,547 | 10/1980 | Bradshaw et al. | 400/613 |
| 4,391,539 | 7/1983 | Connory | 400/208 |
| 4,400,936 | 11/1984 | Kasein et al. | 400/613 X |
| 4,402,619 | 9/1983 | Paque et al. | 400/208 X |
| 4,544,289 | 10/1989 | McGourty et al. | 400/154.5 |
| 4,548,523 | 10/1985 | McGourty et al. | 400/617 |
| 4,557,617 | 12/1985 | Richardson et al. | 400/613 X |
| 4,579,056 | 4/1986 | McGourty et al. | 101/93.19 |
| 4,595,305 | 6/1986 | McGourty et al. | 400/208 |
| 4,678,353 | 7/1987 | Richardson et al. | 400/208 X |

*Primary Examiner*—Charles Pearson
*Assistant Examiner*—James R. McDaniel
*Attorney, Agent, or Firm*—Dorsey & Whitney

[57] ABSTRACT

A unitary tape-ribbon cartridge having an improved ribbon rewind feature for use in a lettering system. The cartridge includes both a tape supply and a ribbon supply provided from tape and ribbon supply housing portions, a guide member for guiding the ribbon toward a lettering station and reversing its direction of movement from a supply path to a rewind path into a ribbon rewind housing portion which is laterally spaced from, but generally parallel to, the tape and ribbon supply housing portions. The ribbon rewind mechanism includes a ribbon rewind spool having a rewind portion and peripheral gear teeth for rotating the same.

9 Claims, 2 Drawing Sheets

UNITARY TAPE-RIBBON CARTRIDGE FOR LETTERING SYSTEM

BACKGROUND OF THE INVENTION

The present invention relates generally to a tape-ribbon supply cartridge for use with a lettering apparatus or type composing system, and more particularly, to a unitary tape-ribbon supply cartridge for housing both a supply of lettering tape and ribbon and supplying the same to a lettering station in the above mentioned apparatus.

Although it is contemplated that the tape-ribbon cartridge of the present invention could be useful in a variety of lettering apparatus or systems embodying various lettering mechanisms, it has particular application to an impact or pressure lettering system of the type described generally in U.S. Pat. Nos. 4,544,289; 4,548,523 and 4,579,056. The lettering system described in the above patents contemplates the use of a separate ribbon supply cassette and a separate tape supply cassette for supplying the ribbon and tape in such system. The ribbon cassette currently used in such lettering systems is the subject of U.S. Pat. No. 4,595,305, while the tape cassette with supply indicator is the subject of pending U.S. patent application Ser. No. 598,554 filed Feb. 17, 1984. Other tape-ribbon cartridges usable in a lettering system and embodying both a tape supply and a ribbon supply currently exist as evidenced by U.S. Pat. Nos. 4,226,547; 4,391,539; 4,402,619 and 4,557,617. The cartridges of U.S. Pat. Nos. 4,226,547 and 4,391,539, however, disclose no ribbon rewind feature. Although the cartridges of U.S. Pat. Nos. 4,402,619 and 4,557,617 do show ribbon rewind features, they are not usable in the above described apparatus.

SUMMARY OF THE INVENTION

In contrast to the prior art, the present invention relates to a unique, unitary cartridge usable in lettering systems of the type described above in which both the tape and ribbon are supplied from a single cartridge. This significantly reduces the time needed to change the tape and ribbon supplies within the machine and also greatly simplifies the maintenance of inventory. Further, the combined tape-ribbon cartridge of the present invention includes a ribbon rewind mechanism which is different than that of current cartridges and permits a significant reduction in the cost of manufacture.

More specifically, the unitary tape-ribbon cartridge of the present invention includes separate tape and ribbon housing portions which are joined with one another and lie in a common plane. Means are also provided for guiding and directing the tape and ribbon, one above the other, to a lettering station and means for reversing the direction of movement of the ribbon and guiding the same into a rewind housing portion. The rewind housing portion lies in a plane spaced from and generally parallel to the plane of the tape and ribbon supply housing portions and includes a ribbon rewind mechanism having a rotatably supported ribbon rewind spool with an outer peripheral gear portion for rotating such spool. The rewind spool includes an inner, cylindrical rewind portion for carrying spent ribbon.

The unitary tape-ribbon cartridge of the present invention also includes a ribbon drive post and appropriately positioned drive and idler gears for transferring rotational movement of the ribbon drive post to the ribbon rewind spool. A unique tension spring is mounted on an interior edge wall of the tape supply housing portion with an end portion bent back upon itself and adapted for engagement with a portion of the ribbon supply spool for creating desired tension. Improved means are also provided for improving and stabilizing the mounting of the cartridge to the machine.

Accordingly, it is an object of the present invention to provide an improved, tape-ribbon unitary cartridge for use in a lettering system of the type described in U.S. Pat. Nos. 4,544,289; 4,548,523 and 4,579,056 in which the tape supply and ribbon supply are incorporated into a single cartridge.

A further object of the present invention is to provide a unitary cartridge for use in the above apparatus, thus insuring against running out of ribbon despite the apparatus detecting only an "out of tape" condition.

Another object of the present invention is to provide a unitary tape-ribbon cartridge including a ribbon rewind mechanism which is much less complex and therefore less expensive to manufacture than those currently existing in the prior art.

A further object of the present invention is to provide a unitary tape-ribbon cartridge which significantly reduces the costs of manufacturing, and reduces the time needed to change, the tape and ribbon in a lettering system of the type described above.

A further object of the present invention is to provide a unitary tape-ribbon cartridge for a lettering system having a unique tension spring for the ribbon supply and improved means for mounting and stabilizing the cartridge relative to the apparatus.

These and other objects of the present invention will become apparent with reference to the drawings, the description of the preferred embodiment and the appended claims.

DESCRIPTION OF THE PREFERRED EMBODIMENT

Figure 1:
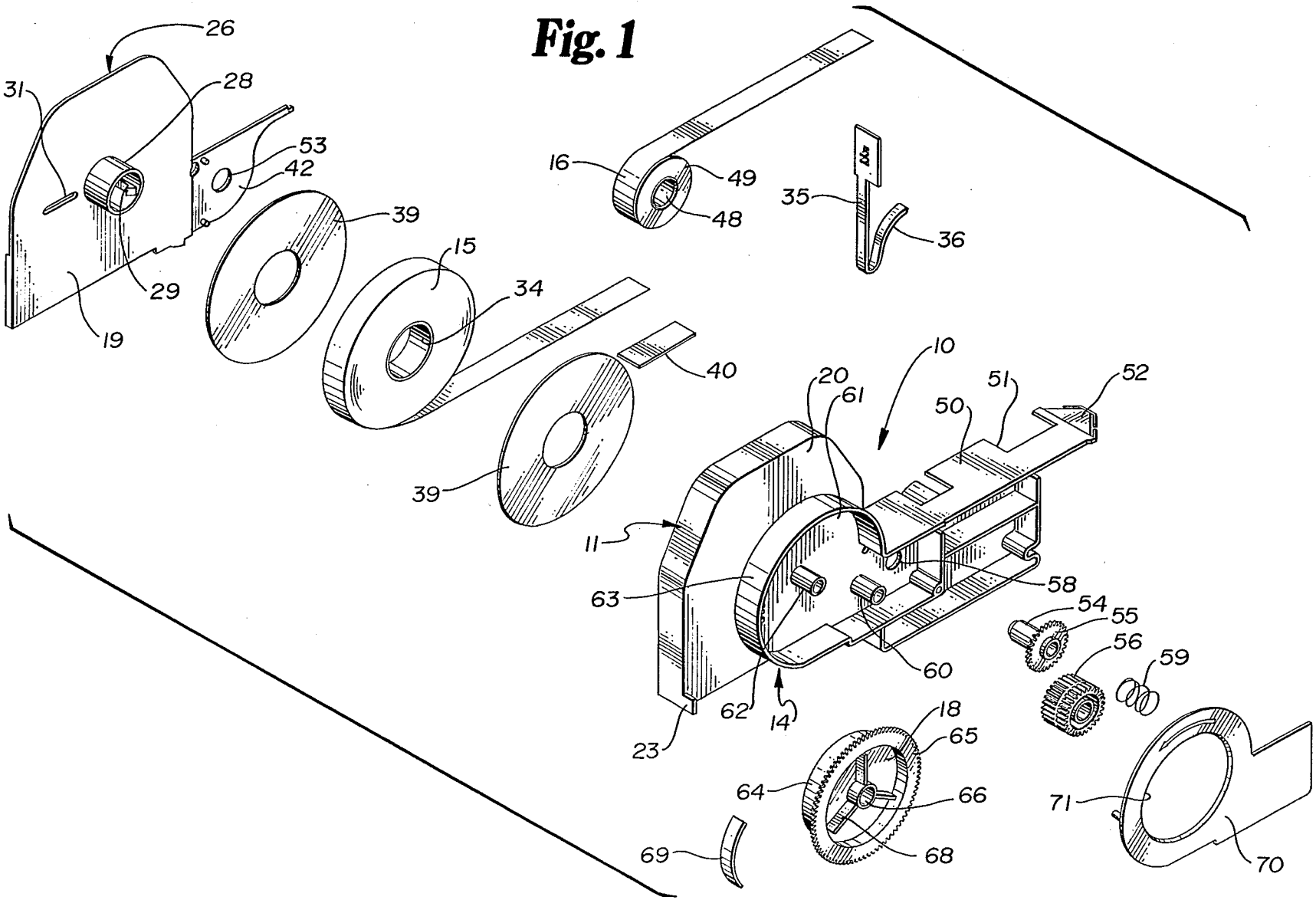
FIG. 1 is a pictorial, exploded view of the unitary tape-ribbon cartridge of the present invention.
Figure 2:
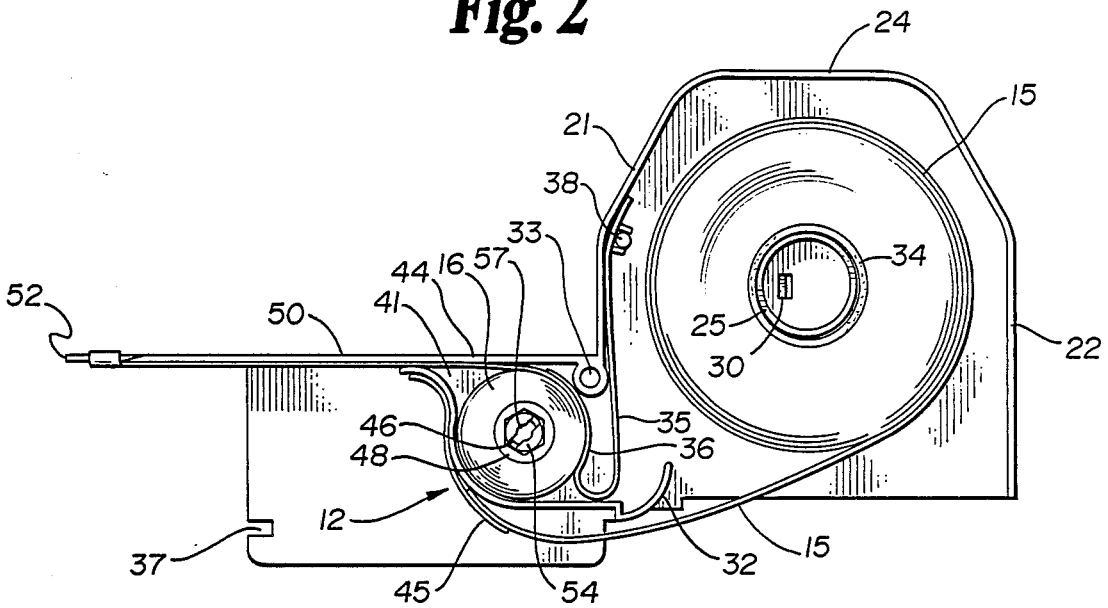
FIG. 2 is a left side view of the unitary tape-ribbon cartridge of the present invention with the left side cover removed.
Figure 3:
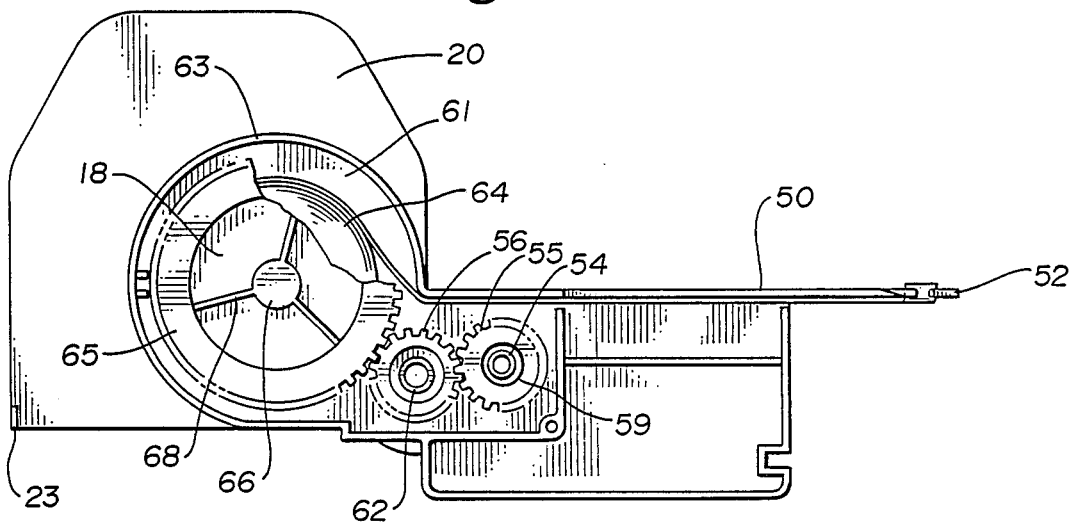
FIG. 3 is a right side view of the unitary tape-ribbon cartridge of the present invention with the right side cover removed.
Figure 4:
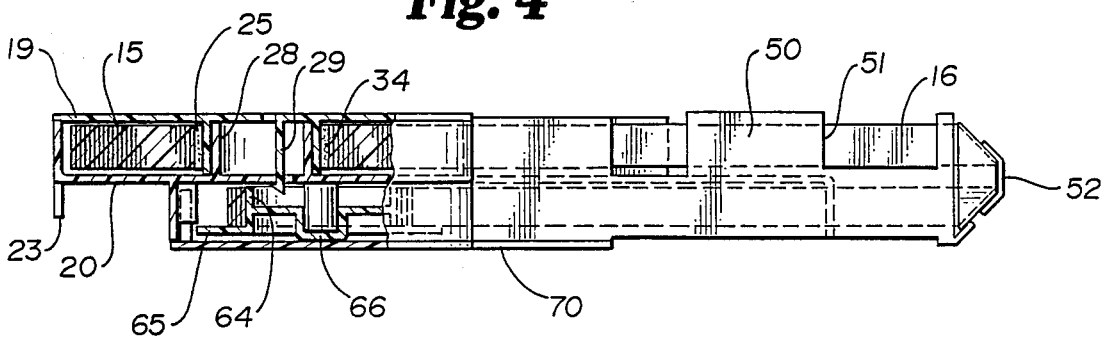
FIG. 4 is a top elevational view, partially in section, of the unitary tape-ribbon cartridge of the present invention, with portions broken away showing the means for guiding the ribbon to the lettering station and back into the rewind housing.

Principal reference is made to the pictorial view of FIG. 1 with secondary reference to FIGS. 2-4. The cartridge of the present invention is a unitary tape-ribbon cartridge 10 having a tape supply housing portion 11, a ribbon supply housing portion 12 (FIG. 2) and a ribbon rewind housing portion 14. Disposed within these housing portions are a spool of tape supply 15, a ribbon supply 16 and a ribbon rewind spool 18, respectively.

The tape supply housing portion 11 is defined by a pair of spaced apart side walls 19 and 20 and forward, rearward and top side edges 21, 22 and 24, respectively. A generally cylindrical tape spool support 25 is centrally positioned within the housing portion 11 and is integrally formed with and extends perpendicular to the side wall 20 for supporting the spool of tape supply 15. The side wall 19 defines a portion of the left side housing cover 26 (FIG. 1) and includes an inwardly extending cylindrical portion adapted and designed to be positioned within the cylindrical spool support 25. A latch member 29 is provided within the cylindrical member 28 for connection to a latch opening 30 within the spool support 25 and the side wall 20. The latch member 29 and latch opening 30 function to retain the side cover 26 during assembly. An elongated tape viewing slot 31 is provided in the side wall 19 to permit viewing of the tape supply within the housing portion 11 to determine the amount of tape supply remaining.

As illustrated best in FIG. 2, the tape supply housing portion 11 is generally closed, except for an open bottom to permit exiting of the tape supply. A curved or sloped tape exit ram and guide member 32 is positioned at the lower forward corner of the tape supply housing portion 11 to assist in guiding the tape out of the housing portion 11 and preventing the same from becoming scratched or bent. A tension control member or spring 35 is mounted to the inside surface of the edge wall 21 via the support post 38 integrally formed with the side wall 20. The tension control member or spring 35 extends downwardly along the edge wall 21 to a point near the bottom of the housing 11 at which point it curves back upon itself and terminates in a curved tension control or spring end 36 for engagement with, and controlling the tension on the ribbon supply spool 16 in the manner described below.

As illustrated best in FIGS. 1 and 4, a support and alignment tab 23 extends outwardly from the rear edge wall 22 for engagement with a portion of the machine to facilitate proper alignment, support and stability of the cartridge relative to the machine. A pair of cartridge mounting and alignment openings 33 and 37 (FIG. 2) are also provided for mounting the cartridge on the machine.

The spool of tape 15 is mounted on a central core 34 which is rotatably supported with respect to the spool support member 25. A pair of tack or other disc members 39 are disposed on opposite sides of the tape supply spool 15 to maintain the tape supply in a compact, tight configuration and to also provide limited resistance to the free rotation of the tape spool 15. A short adhesive member 40 is connected to the end of the tape supply 15 to secure the same to a portion of the cartridge prior to use.

The ribbon supply housing portion 12 is defined by a pair of spaced side walls 41 and 42, a top edge wall 44 and a curved bottom and front side wall 45. As illustrated, the side wall 41 lies in a common plane with the side wall 20 and the side wall 42 is generally coplanar with the side wall 19 and forms a part of the left side cover 26 (FIG. 1). A ribbon support post 46 is integrally formed with the side wall 49 and extends outwardly at right angles from such wall to support the spool of ribbon 16. The spool 16 includes a central hub portion 48 upon which the ribbon supply is wound and an outwardly extending flange portion 49 connected with an inner end of the hub 48 to provide support for the ribbon supply spool 16 and to space the ribbon 16 from the side wall 41 to prevent interference therewith.

As illustrated best in FIG. 2, the contact end 36 of the tension control member 35 is adapted for engagement with an outer surface portion of the ribbon spool 16 to provide a desired tension or resistance to the rotation of the spool 16. Preferably, the end 36 should exert sufficient force on the spool 16 so that a force between about 5 and 12 grams is needed to pull the ribbon from the spool 16.

It should be noted that the ribbon supply housing portion 12 and the tape supply housing portion 11 lie in a common plane so that they can be supplied to the lettering station with the ribbon 16 directly above the tape 15.

The cartridge of the present invention also includes an elongated guide member 50 extending forwardly from the ribbon supply housing portion 12 for guiding the ribbon 16 along a ribbon supply path toward the lettering station of the apparatus and then reversing the direction of such tape and guiding the same back along a ribbon rewind path into the rewind housing. The member 50 for accomplishing this guiding movement and direction reversal is common in the art. However, as illustrated best in FIG. 4 the ribbon is directed from the cartridge past an opening 51 in the guide member 50 and around the end 52. In the preferred embodiment, the opening 51 defines the general position of the lettering station. The end 52 includes a pair of diagonal surfaces for changing direction of the ribbon 16 from a forward supply path toward the lettering station to a rearward direction along a rewind path generally parallel to the supply path.

The ribbon rewind mechanism of the unitary tape-ribbon cartridge of the present invention is illustrated best in FIGS. 1 and 3. As shown, the ribbon rewind housing portion 14 lies in a plane spaced from and generally parallel to the tape and ribbon supply housing portions 11 and 12. The ribbon rewind housing 14 is defined by an inner side wall 61 and a right side cover portion 70. As shown, the side wall 61 is defined by the outer surface of the wall which serves as the side wall 20 of the tape supply housing 11. An edge wall 63 extends around the ribbon rewind housing portion 14.

The specific ribbon rewind mechanism of the unitary tape-ribbon cartridge of the present invention includes a ribbon drive post 54 extending through an opening 58 in the side wall 61 and into and through the hollow support post 46 within the ribbon supply housing portion 12 so that a first or outer end of the ribbon drive post 54 is accessible through an opening 53 (FIG. 1) in the side wall 42. As shown in FIG. 2, the first end of the ribbon drive post 54 includes an appropriate notch 57 or other means for engagement with a drive member on the lettering machine.

A second or inner end of the ribbon drive post 54 includes a drive gear member 55 integrally formed with the post 54 and disposed within the ribbon rewind housing 14. The drive gear 55 is provided with a plurality of gear teeth about its periphery for engagement with a rotatable idler gear 56. The idler gear 56 also includes a plurality of gear teeth about its periphery and is supported for rotation within the rewind housing about the idler gear post 60. A spring or bias member 59 is positioned between the second or inner end of the ribbon drive post 54 and the inner surface of the cover plate 70 to bias the drive gear 55 and ribbon drive post 54 toward engagement with the drive member on the lettering apparatus. As illustrated best in FIG. 2, the drive post 54 is adapted to rotate within the ribbon supply spool support 46.

The ribbon rewind spool 18 includes a central hub portion 66 and is rotatably supported within the rewind housing 14 about the ribbon rewind support post 62.

The rewind spool 18 also includes a generally cylindrical inwardly positioned ribbon rewind portion 64 and an outer peripheral edge portion 65 having a plurality of gear teeth 65 for engagement with the gear teeth on the idler gear 56. The diametrical dimension of the ribbon rewind portion 64 should preferably be as large as possible. A large diametrical dimension is desired to provide as much consistency as possible in the advancement of the ribbon. Because the ribbon 16 in the present cartridge is advanced by rotation of the spool 18 (as a result of microprocessor controlled rotation of the drive post 54), and since the incremental amount of rotation is independent of the amount of ribbon on the rewind spool, the actual amount of advancement will depend on the radial position of the ribbon 16 on the rewind spool 18. In other words, the ribbon advancement will be increased as layers of ribbon are built up on the portion 64. Preferably, the diametrical dimension of the rewind portion 64 should be at least 1 ½ inches in diameter and preferably about 1 ½ times the outer diameter of the ribbon spool 16 before use. A slight decrease in the diameter of the rewind portion 64 will require significantly more ribbon on the supply spool.

As shown best in FIGS. 1 and 3, the ribbon rewind spool 18 also includes a plurality of spokes 68 extending radially outwardly from the central hub 66 to provide means for manually rotating the rewind spool 18. It should be noted that the entire hub 66 and spoke members 68 ar positioned inwardly of the outer cover 70 so that no part of the mechanism for manually rotating the spool 18 is located outside of the plane defined by the cover 70. The right side cover plate 70 includes a generally circular opening 71 to provide manual access to the rib or spoke members 68. It should be noted that the size of the opening 70 is large enough to permit manual rotation of the spool 18, but small enough to totally cover the gear teeth on the peripheral portion 65.

During operation, the ribbon advancing member within the machine (not shown) rotates the ribbon drive post 54 in a clockwise direction as viewed in FIG. 2. This rotational movement of the drive post 54 results in clockwise rotation (as viewed in FIG. 3) of the idler gear 56 by virtue of engagement with the drive gear 55. Such rotation of the idler gear 56 causes corresponding counterclockwise rotation (as viewed in FIG. 3) of the ribbon rewind spool 18. Such rotation of the spool 18 causes the spent ribbon to be wound upon the ribbon rewind portion 64, thus pulling the ribbon through the guide system defined by the elongated guide member 50 and from the ribbon supply spool 16.

Although the description of the preferred embodiment has been quite specific, it is contemplated that various changes could be made without deviating from the spirit of the present invention. Accordingly, it is intended that the scope of the present invention be dictated by the appended claims, rather than by the description of the preferred embodiment

I claim:

1. A unitary tape-ribbon cartridge for supplying tape and ribbon to the lettering station of a lettering system comprising:

a tape supply housing portion having a pair of spaced tape supply side walls and front, rear and top edge walls;

a spool of tape totally supported within said tape supply housing portion about an axis generally perpendicular to said pair of tape supply side walls;

a ribbon supply housing portion having a pair of spaced ribbon supply side walls, said ribbon supply housing and said tape supply housing lying in a common plane;

a ribbon drive post extending between and perpendicular to said ribbon supply side walls, said drive post including a first end aligned with an opening in one of said ribbon supply side walls and having means for engaging a drive member of said lettering system and a second end extending through an opening in the other of said ribbon supply side walls;

a spool of ribbon rotatably supported within said ribbon supply housing portion about an axis generally perpendicular to said pair of ribbon supply side walls;

a ribbon rewind housing portion disposed in a plane spaced from and parallel to said tape supply and ribbon supply housing portions and including a pair of spaced ribbon rewind housing side walls in which one of said ribbon rewind housing side walls is common with a portion of one of said tape supply housing side walls and in which the other of said ribbon rewind housing walls includes an access opening;

an elongated ribbon guide member extending outwardly from said ribbon supply housing portion for guiding said ribbon along a supply path toward said lettering station;

means at the end of said ribbon guide member for reversing the direction of movement of said ribbon and directing it along a rewind path generally parallel to said supply path and into said ribbon rewind housing portion;

a rewind drive gear connected with said second end of said ribbon drive post;

a rewind idler gear rotatably supported on an axis generally parallel to said ribbon drive post and in fixed operative engagement with said rewind drive gear;

a ribbon rewind spool rotatably supported about an axis generally parallel to said ribbon drive post, said rewind spool having an outer peripheral gear portion in fixed operative engagement with said idler gear and an inner cylindrical ribbon rewind portion aligned with said rewind path, whereby rotation of said drive post causes rotation of said ribbon rewind spool and winding of spent ribbon on sqaid rewind portion; and manual rotation means comprising at least one spoke member disposed radially inwardly of said inner cylindrical ribbon rewind portion for selectively, manually rotating said rewind spool, said manual rotation means being manually accessed through said access opening and being fully contained within said ribbon rewind housing portion such that no part of said rotation means extends outwardly from said other of said ribbon rewind housing side walls

2. The tape-ribbon cartridge of claim 1 wherein said tape supply housing portion includes an open bottom and a curved tape guide portion near the lower, forward corner of said tape supply housing portion.

3. The tape-ribbon cartridge of claim 1 including a ribbon tension control member.

4. The tape-ribbon cartridge of claim 3 wherein said ribbon tension control member comprises a spring element having a first end connected with an inner surface of said front edge wall, an intermediate portion extending downwardly to a point near the bottom of said tape supply housing portion and a curved, second end extending upwardly from said point near the bottom of said tape supply housing portion and into surface engagement with a portion of said ribbon supply spool.

5. The tape-ribbon cartridge of claim 1 including an alignment and support tab extending outwardly from a lower end of said rear edge wall of said tape supply housing portion.

6. The tape-ribbon cartridge of claim 1 including means biasing said ribbon drive post toward engagement with the drive member of said lettering system.

7. The tape-ribbon cartridge of claim 1 wherein said means for manually rotating said rewind spool includes a plurality of spoke members.

8. The tape-ribbon cartridge of claim 1 wherein the diametrical dimension of said ribbon rewind portion is at least $1\frac{1}{2}$ inches.

9. The tape-ribbon cartridge of claim 1 wherein the diametrical dimension of said ribbon rewind portion is at least $1\frac{1}{2}$ times the outer diametrical dimension of said spool of ribbon.

* * * * *